United States Patent [19]

Wünsch

[11] Patent Number: 4,974,758

[45] Date of Patent: Dec. 4, 1990

[54] NEEDLE FOR A MACHINE FOR SEWING THE LONGITUDINAL SEAM OF A NECKTIE

[75] Inventor: Reinhard Wünsch, Krefeld, Fed. Rep. of Germany

[73] Assignee: Herbert Janssen, Nahmaschinen, Krefeld, Fed. Rep. of Germany

[21] Appl. No.: 361,917

[22] Filed: Jun. 5, 1989

[30] Foreign Application Priority Data

Jun. 7, 1988 [DE] Fed. Rep. of Germany ... 8807418[U]

[51] Int. Cl.[5] ..... D05B 85/00; D05B 85/02; D05B 85/06; D05B 85/08

[52] U.S. Cl. ..... 223/102; 112/222; 112/224; 112/225

[58] Field of Search ..... 223/102, 103, 104; 112/222, 223, 224, 225, 226, 227

[56] References Cited

U.S. PATENT DOCUMENTS

| | | | |
|---|---|---|---|
| 278,459 | 5/1883 | Rusling et al. | 223/102 |
| 286,014 | 10/1883 | Jenkins | 112/224 |
| 672,682 | 5/1901 | McLeod | 112/223 |
| 2,184,256 | 12/1939 | Naftali et al. | 225/112 X |
| 3,116,707 | 5/1962 | Newman | 112/222 |

FOREIGN PATENT DOCUMENTS

| | | | |
|---|---|---|---|
| 1006244 | 4/1957 | Fed. Rep. of Germany | 223/102 |
| 30893 | of 1897 | United Kingdom | 223/102 |

*Primary Examiner*—Werner H. Schroeder
*Assistant Examiner*—Bibhu Mohanty
*Attorney, Agent, or Firm*—Herbert Dubno

[57] ABSTRACT

A needle for forming the longitudinal stitching seam of a necktie has a needle point to which a wire is attached, the wire being capable of being rolled up on the needle spool of the necktie sewing machine. To reduce the complexity of the device required to thread a yarn into the needle point, the latter is formed with a hook whose outer surface is flush with the surface of the needle point and beneath which is provided a recess extending beyond the hook in the direction of the wire.

1 Claim, 1 Drawing Sheet

NEEDLE FOR A MACHINE FOR SEWING THE LONGITUDINAL SEAM OF A NECKTIE

FIELD OF THE INVENTION

My present invention relates to a needle for a machine for the stitching of the longitudinal seam of a necktie and, more particularly, to a meedle of the type in which a coilable long wire carries the needle point at one end thereof and the needle can be wound upon and unwound from a drum during the formation of the longitudinal seam of the necktie.

BACKGROUND OF THE INVENTION

Machines for the formation of the longitudinal seam of a necktie generally are intended to form this seam along the backside of the necktie.

For this purpose, an extremely long flexible needle is used since the needle must pass through the entire length of the necktie along the seam which is formed until it emerges from the opposite end of the necktie. As a consequence, the needle comprises a needle point and a wire connected to the needle point so that the needle point can be said to be formed at one end of the wire.

The wire is wound up on a needle spool and is initially unrolled to move the needle point to the opposite side of the machine.

When the needle point arrives at this opposite side, the needle point is guided into a needle abutment screw which forms part of a threading arrangement coacting with the needle point so that a part can move with the needle point until the needle point reaches a predetermined position at which a yarn is threaded into the needle eye.

The construction of the threading device, because of the need to guide the yarn with precision into the needle eye, is therefore relatively complex.

For a variety of reasons, however, the needle eye does not always lie at the precisely required angle to the threading device. This angular misalignment may be a result of an inaccurate welding of the needle point onto the wire, some damage to the wire or to the needle point or a consequence of a twisting of the needle point resulting from its engagement with the material to be sewn.

As a consequence, a yarn may not be threaded into the needle eye accurately every time. Only when a yarn has been properly threaded into the needle eye is a completion signal given so that the needle can return and the seam made.

OBJECTS OF THE INVENTION

It is the principal object of the present invention to provide an improved needle for the sewing of the longitudinal seam of a necktie whereby the above mentioned drawbacks can be avoided.

Another object of this invention is to provide an improved needle for the purposes described which will ensure proper engagement of the yarn in the needle point in a realiable manner and without failure of the threading process.

SUMMARY OF THE INVENTION

These objects and others which will become apparent hereinafter are attained, in accordance with the invention by providing the needle point so that it does not have the usual eye but rather is formed as a so-called hook needle, such needles being long used in knitting and crocheting processes.

According to the invention, the needle point is provided with a hook turned toward the wire and away from the pointed tip of the needle point.

Advantageously, the exterior of the hook is flush with the outer surface of the needle point and the needle point is formed below the hook with a recess which extends in the direction of the wire beyond the free end of the hook.

Utilizing the needle of the present invention, I can completely eliminate the need for carefully guiding the yarn through an eye in the needle because the yarn is automatically engaged by the hook and seized thereby during the return stroke of the needle and thus is entrained by the needle point in the desirable manner. The position of the hook and the associated recess is not critical since a yarn engagement can be ensured even with slight inclinations of the needle pont of variations in the angular positioning thereof. The threading device does not require expensive and failure-prone movable parts to adjust to the position of the needle point since an exact positioning of the hook is not required.

The needle abutment screw can be completely eliminated so that the risk of damage to the needle point is greatly reduced.

It is also no longer necessary to reduce the velocity of the needle in its advancing stroke before it reaches the needle abutment screw or its final position. Thus even the speed of the machine can be improved in accordance with this invention.

BRIEF DESCRIPTION OF THE DRAWINGS

The above and other objects, features and advantages of my invention will become more readily apparent from the following description, reference being made to the accompanying highly diagrammatic drawing in which.

SPECIFIC DESCRIPTION

Figures 1, 2:
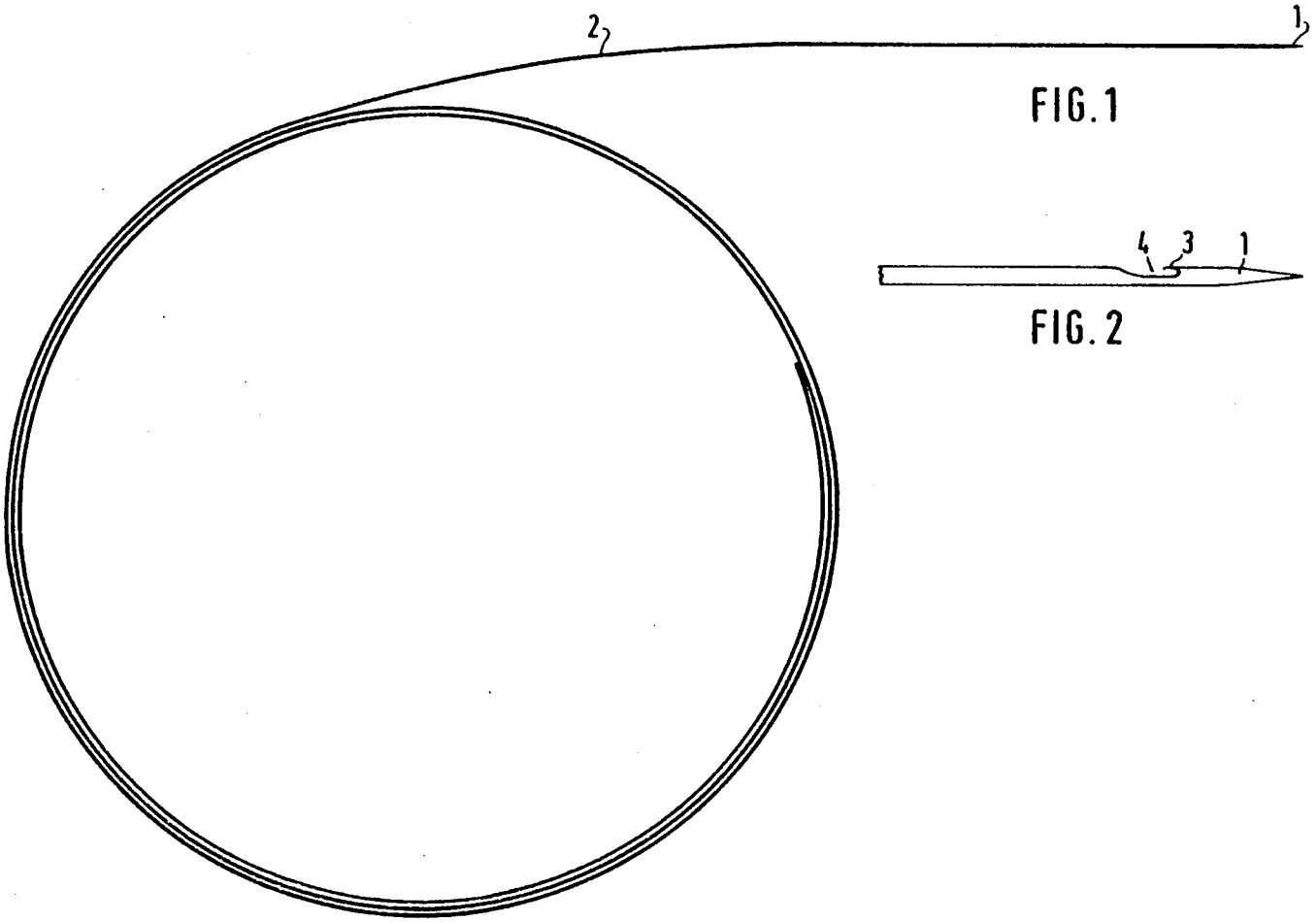
FIG. 1 is a schematic side elevational view of a needle for a machine for the stitching of the longitudinal seam of a necktie.
FIG. 2 is an enlarged view of the needle point of the needle shown in FIG. 1.

The needle shown in FIGS. 1 and 2 is used in a conventional machine for the stitching of the longitudinal stitch seam for a necktie and comprises a relatively rigid needle point 1 and a wire 2 extending from the needle point and which can have somewhat greater flexibility. The connection between the needle point and the wire can be affected by welding or in some other manner.

The wire 2 has been shown in FIG. 1 to be wound up. The length of the wire 2 is usually around 2300 millimeters and its diameter usually about one millimeter.

As can be seen from FIG. 2, the needle point 1 is constituted as a hook needle and thus is formed with a hook as extending toward the wire and away from the pointed tip of the needle.

The exterior of the hook 3 is flush with the surface of the needle point 1.

Below the hook 3 a recess 4 is provided, this recess opening beyond the hook in the direction of the wire.

The hook, as will be apparent from FIG. 2, thus uses the principles of a crocheting needle to engage the yarn which need only be positioned adjacent the needle point to assure its reliable seizure on the return stroke of the needle.

I claim:

1. A needle for sewing a longitudinal seam in a necktie and adapted to pass completely through the necktie, said needle comprising a coilable wire and a needle point provided at a first end of the wire, said needle point being formed as a hook needle with a hook adapted to engage a seam-forming thread upon longitudinal displacement of the needle point, said hook opening toward a second end of said wire opposite said first end, said hook having a minor leg with an outer surface coplanar with an outer surface of said needle point, said needle point being formed with a recess below said hook and extending beyond an end of said minor leg toward said second end of said wire, and said hook being the only hook of said needle.

* * * * *